US007522111B2

(12) United States Patent
Opitz

(10) Patent No.: US 7,522,111 B2
(45) Date of Patent: Apr. 21, 2009

(54) TELESCOPING ANTENNA WITH RETRACTABLE WIRE ANTENNA ELEMENT

(75) Inventor: Rodney Paul Opitz, Arlington, TX (US)

(73) Assignee: Uniden America Corporation, Fort Worth, TX (US)

( * ) Notice: Subject to any disclaimer, the term of this patent is extended or adjusted under 35 U.S.C. 154(b) by 0 days.

(21) Appl. No.: 11/839,278

(22) Filed: Aug. 15, 2007

(65) Prior Publication Data

US 2009/0046032 A1 Feb. 19, 2009

(51) Int. Cl.
*H01Q 1/24* (2006.01)

(52) U.S. Cl. ..... 343/702; 343/901; 343/903

(58) Field of Classification Search ..... 343/702, 343/715, 900, 901, 903
See application file for complete search history.

(56) References Cited

U.S. PATENT DOCUMENTS

| | | | | |
|---|---|---|---|---|
| 2,344,425 | A * | 3/1944 | Snyder | 343/901 |
| 2,493,787 | A | 1/1950 | Torretti | |
| 2,537,481 | A | 1/1951 | Parsons | |
| 3,201,693 | A | 8/1965 | Vacek et al. | |
| 3,500,429 | A | 3/1970 | Majkrzak et al. | |
| 4,048,638 | A * | 9/1977 | Cejka | 343/894 |
| 4,658,260 | A | 4/1987 | Myer | |
| 4,742,360 | A | 5/1988 | Carolus et al. | |
| 4,920,354 | A * | 4/1990 | Rauser et al. | 343/901 |
| 5,017,935 | A * | 5/1991 | Hayashi et al. | 343/715 |
| 5,079,562 | A | 1/1992 | Yarsunas et al. | |
| 5,189,435 | A | 2/1993 | Yarsunas et al. | |
| 5,414,436 | A * | 5/1995 | Shinkawa et al. | 343/715 |
| 5,865,390 | A | 2/1999 | Iveges | |
| 6,268,830 | B1 * | 7/2001 | Nakagawa et al. | 343/702 |
| 2002/0118135 | A1 * | 8/2002 | Johnson et al. | 343/702 |

* cited by examiner

*Primary Examiner*—HoangAnh T Le
(74) *Attorney, Agent, or Firm*—Brian E. Harris; James E. Walton

(57) ABSTRACT

A telescoping antenna is disclosed having a plurality of telescoping hollow elements, including an inner-most hollow element. A button latches onto the top of the inner-most element. The inner-most element also includes a tab for preventing its full retraction into the other hollow elements. A wire antenna element is connected to the button, extends through the hollow elements, and is operably connected to a retracting mechanism. The button can be detached from the hollow elements in order to extend the wire antenna elements from out of the hollow elements. The wire antenna element is electrically connected to the receiver circuit such that the wire can act as a long-wire antenna of a calculable radio frequency (RF) resonance when extracted to a particular length.

20 Claims, 4 Drawing Sheets

TELESCOPING ANTENNA WITH RETRACTABLE WIRE ANTENNA ELEMENT

BACKGROUND

1. Field of the Invention

This invention relates in general to antennas for receiving and/or transmitting radio waves, and in particular, to an improved antenna for a portable receiver or transceiver.

2. Description of Related Art

For a handheld or portable radio receiver or transceiver, it is desirable to have a telescoping antenna that can be adjusted for best performance over a particular frequency range. For some configurations, it is not practical to cover all antenna lengths that might be needed with a single telescoping antenna mechanism. For example, shortwave radio frequencies can require an antenna many feet long for adequate reception. A telescoping antenna of such length is not typically practical or desirable on a portable device.

DESCRIPTION OF THE DRAWINGS

The novel features believed characteristic of the invention are set forth in the appended claims. However, the invention itself, as well as a preferred mode of use, and further objectives and advantages thereof, will best be understood by reference to the following detailed description when read in conjunction with the accompanying drawings, wherein:

DETAILED DESCRIPTION OF THE PREFERRED EMBODIMENT

Prior telescoping antennas typically are made up of one or more hollow elements with a single solid element as the inner-most (smallest diameter) extension piece. A "button" at the top end of the inner-most element prevents the last extension piece from being retracted too far into the hollow elements, and also provides a convenient point for grasping the antenna during extension. The antenna of the present disclosure replaces the inner-most solid element with an inner-most hollow element as the last element. A button latches onto the top of the last element. The last element also can include a tab for preventing its full retraction into the other hollow elements. A wire antenna element is connected to the button, extends through the hollow elements, and is operably connected to a retracting mechanism. The button can be detached from the hollow elements in order to extend the wire antenna elements from out of the hollow elements. The wire antenna element is electrically connected to the receiver circuit such that the wire can act as a long-wire antenna of a calculable radio frequency (RF) resonance when extracted to a particular length.

Figure 1:
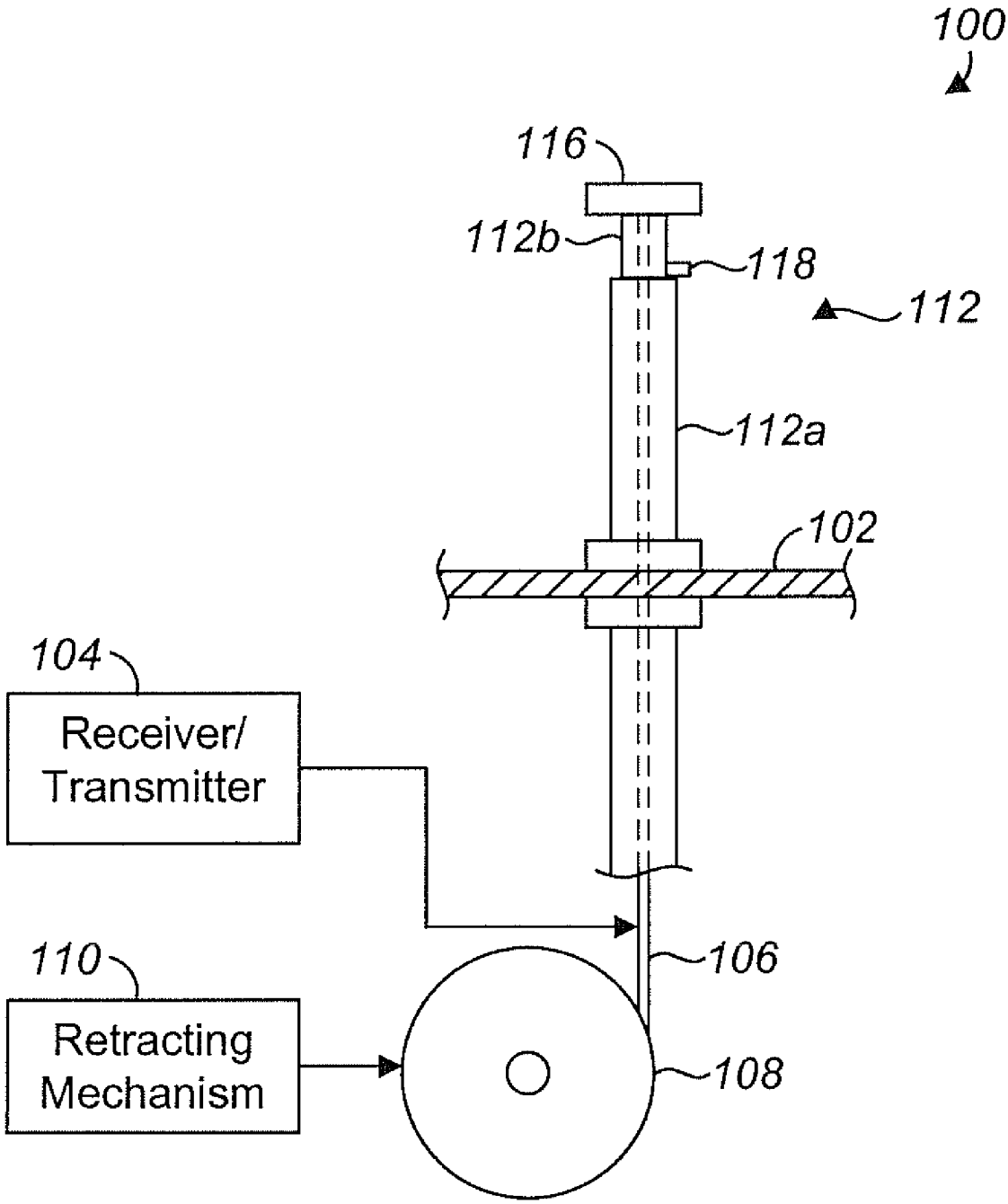
FIG. 1 shows a radio having a telescoping antenna assembly according to the present disclosure with the antenna in a fully retracted position.

Referring to FIG. 1 in the drawings, an antenna assembly 100 is illustrated. Antenna assembly 100 is a telescoping antenna and is shown in the retracted position. The antenna assembly is mounted to a housing 102 of a receiver or transceiver radio that includes receiver and/or transmitter circuitry generally shown as receiver/transmitter 104. The antenna assembly 100 includes a flexible wire antenna element 106 that is electrically connected to the receiver/transmitter circuit 104. The flexible wire antenna element 106 can be, for example, bare copper wire, insulated copper wire, bare or insulated copper alloy wire, or bare or insulated wire formed of some other material suitable for use as a wire antenna.

A portion of the wire antenna element 106 is wound around a spool 108. The spool 108 is rotatable to allow the wire antenna element 106 to be unwound from the spool 108 to an extended position. A retracting mechanism 110 controls the spool 108 to wind the wire antenna element 106 back on the spool 108, thereby retracting the wire antenna element 106 from an extended position.

The wire antenna element 106 extends from the spool 108, through a plurality of elongated, rigid telescoping tubes 112 and attaches to a button 116. The telescoping tubes 112 include an outermost tube 112*a* and an innermost tube 112*b*. The outermost tube 112*a* is secured to the housing 102, for example using hardware and/or adhesive. The telescoping tubes 112 have aligned longitudinal axes and successively decreasing transverse dimensions to permit each of the tubes 112 to axially slide therebetween. The telescoping tubes 112 are also hollow to permit the wire antenna element 106 to pass through the inside of the tubes 112. Note that in FIGS. 1-3 the portion of the wire antenna element 106 passing through the hollow tubes 112 is shown in broken lines. The outermost tube 112*a* has the largest transverse dimension and is securable to the housing 102. The innermost tube 112*b* has the smallest transverse dimension and is axially moveable relative to the outermost tube 112*a*, as well as other tubes 112.

In some embodiments, the tubes 112 can be conductive. In such embodiments, the tubes 112 can be formed of metal, for example stainless steel or chrome-plated bronze. In such embodiments, the tubes 112 can be conductively connected to each other and to the wire antenna element 106.

In other embodiments, the tubes 112 can be RF transparent. In such embodiments, the tubes 112 can be formed of a plastic or polymer material.

A tab 118 is attached to the innermost tube 112*b* and serves as a down-stop for preventing the innermost tube 112*b* from sliding too far down into the other tubes 112.

Figure 2:
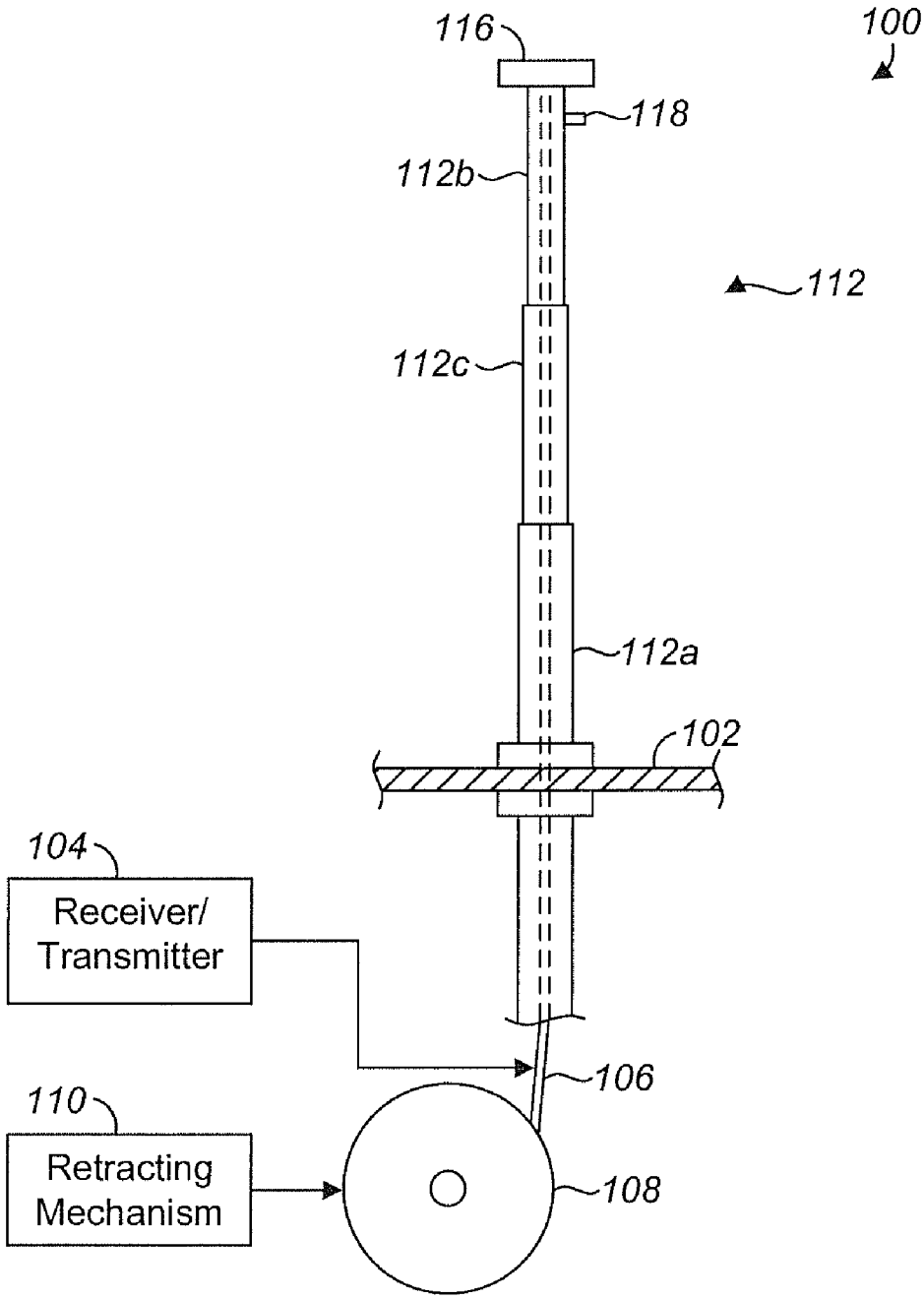
FIG. 2 shows the radio and telescoping antenna assembly shown in FIG. 1 with the antenna in an extended position.

Referring next to FIG. 2 in the drawings, the antenna assembly 100 is shown with the tubes 112 extended. The tubes 112 are telescoping such that a user can freely move the tubes 112 between the retracted position shown in FIG. 1 and the extended position shown in FIG. 2. The spool 108 spins to allow the wire antenna element 106 to extend while the tubes 112 are extended as shown in FIG. 2, and the retracting mechanism 110 causes the spool 108 to wind the wire antenna element 106 back onto the spool 108 as the tubes 112 are retracted as shown in FIG. 1. In some embodiments, the retracting mechanism 110 can be used to retract the tubes 112 from the position shown in FIG. 2 to the position shown in FIG. 1 by pulling the wire antenna element 106 back onto the spool 108, which in turn pulls the button 116 towards the outermost tube 112*a* causing the tubes 112 to retract. In alternative embodiments, the spool 108 can be mechanically connected to the tubes 112 such that the spool 108 spins as the tubes are extended and retracted, thereby winding and unwinding the wire antenna element 106 as needed.

Note that, in addition to an innermost tube 112*b* and an outermost tube 112*a*, the plurality of tubes 112 also includes an intermediate tube 112*c*. While the illustrated embodiment includes three tubes 112*a*-112*c*, alternative embodiments can include any number of tubes 112.

Figure 3:
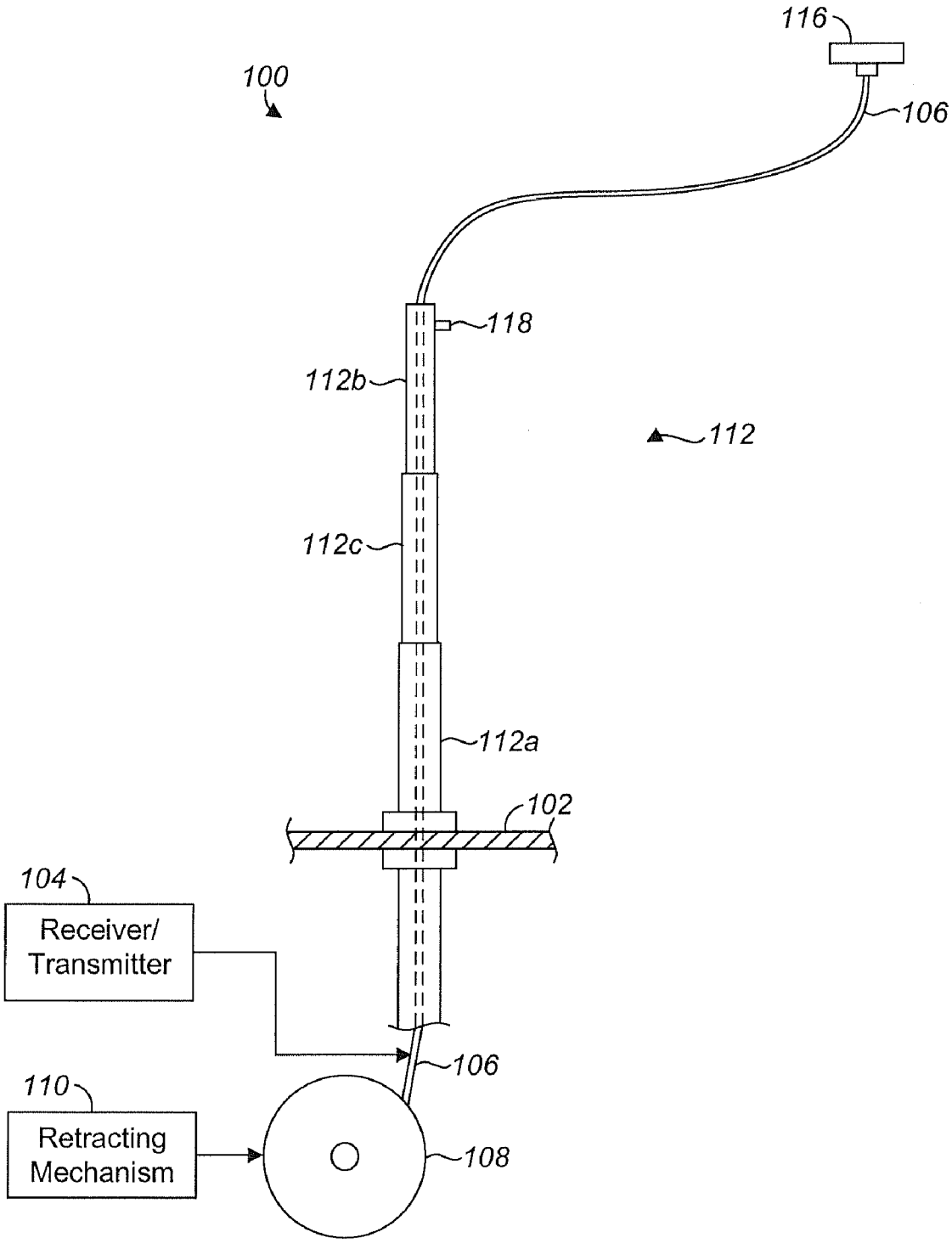
FIG. 3 shows the radio and telescoping antenna assembly shown in FIGS. 1 and 2 with the antenna in an extended position and with the wire antenna element extended.

Referring next to FIG. 3 in the drawings, the antenna assembly 100 is shown with the tubes 112 extended and the wire antenna element 106 extended from out of the innermost tube 112*b*. The button 116 is detachable from the innermost tube 116. The button 116 can be configured to snap, twist, and/or screw onto the innermost tube 112*b*. For example, the button 116 can be configured to attach to the innermost tube

112*b* via a conventional bayonet-mount fastening mechanism. Alternatively, the button 116 can be attached to the innermost tube 112*b* via a spring-latch mechanism that requires a user to press a latch in order to release the button 116 from the innermost tube 112*b*. Once the button 116 is detached from the innermost tube 112*b*, the button 116 can be pulled in order to extract a portion of the wire antenna element 106 as shown. Depending on the size and material of the wire antenna element 106, the wire antenna element 106 may be more or less rigid. In some embodiments, the wire antenna element 106 can be flexible enough that it limply hangs from the upper end of the innermost tube 112*b* (the end of the innermost tube 112*b* from which the wire antenna element exits the tubes 112).

Figure 4:
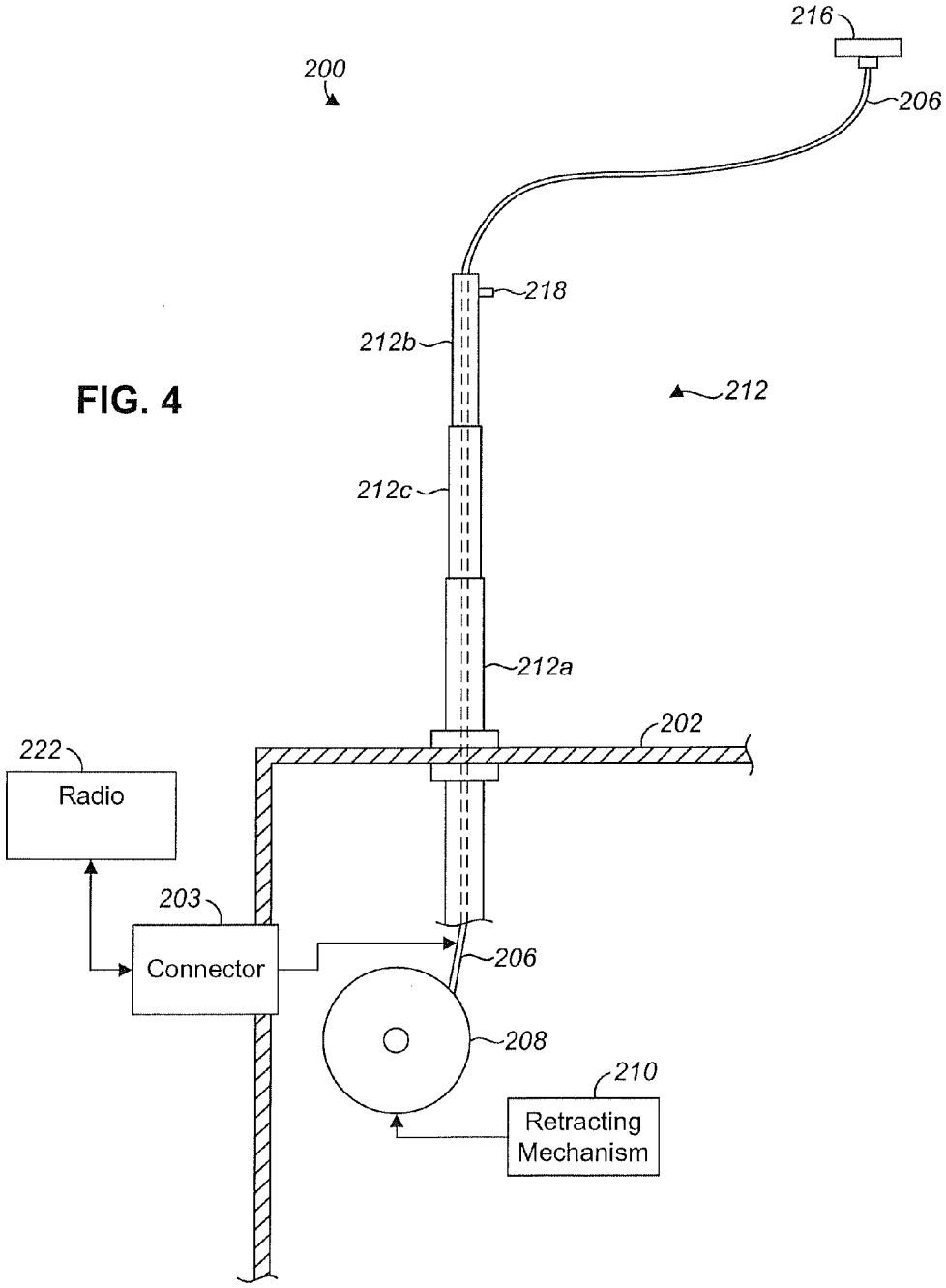
FIG. 4 show an alternative telescoping antenna assembly that is externally-mountable to a radio.

Referring next to FIG. 4 in the drawings, an antenna assembly 200 is illustrated. The antenna assembly 200 is similar to the antenna assembly 100, with a primary difference being that the antenna assembly 200 can be used as an accessory antenna that mounts to an external antenna connector such as is commonly provided on many conventional radios, for example scanner radios. The antenna assembly 200 is a telescoping antenna that can be retracted in the same manner as the antenna assembly 100 shown in FIG. 1 and extended in the same manner as the antenna assembly 100 shown in FIG. 1.

The antenna assembly 200 includes a housing 202 having a connector 203 for operably and detachably connecting the antenna assembly 200 to a radio 222. For example, the connector 203 can be a conventional RF connector such as conventional bayonet-mount fastening mechanism, for example a BNC (bayonet Neill-Concelman) connector. In some embodiments the connector 203 can be mounted directly onto the housing 202, while in alternative embodiments the connector 203 can be connected to the housing via a conductor, such as a coaxial cable or the like, thereby allowing the antenna assembly 200 to be located some distance from the radio 222. The antenna assembly 200 includes a flexible wire antenna element 206 that is electrically connected to the connector 203 such that, when the connector 203 is connected to the radio 222, the wire antenna element 206 can serve as an antenna for the receiver and/or transmitter of the radio 222. The flexible wire antenna element 206 can be, for example, bare copper wire, insulated copper wire, bare or insulated copper alloy wire, or bare or insulated wire formed of some other material suitable for use as a wire antenna.

A portion of the wire antenna element 206 is wound around a spool 208. The spool 208 is rotatable to allow the wire antenna element 206 to be unwound from the spool 208 to an extended position. A retracting mechanism 210 controls the spool 208 to wind the wire antenna element 206 back on the spool 208, thereby retracting the wire antenna element 206 from an extended position. There are a number of different ways in which the retracting mechanism 210 can be implemented. For example, the retracting mechanism 210 can include a hand-crank for allowing a user to manually retract the wire antenna element 206; the retracting mechanism 210 can include a spring and latch mechanism, for example where a spring urges the spool 208 to retract the wire antenna element, and a user-releasable latch allows the wire antenna element 206 to remain retracted against the force of the spring; the retracting mechanism 210 can include a user-controlled motor for driving the spool 208 to retract the wire antenna element; and/or the retracting mechanism 210 can include any combination of these types of mechanisms. Any other known retracting means can additionally or alternatively be used as the retracting mechanism 210.

The wire antenna element 206 extends from the spool 208, through a plurality of elongated, rigid telescoping tubes 212 and attaches to a button 216. The telescoping tubes 212 include an outermost tube 212*a* and an innermost tube 212*b*. The outermost tube 212*a* is secured to the housing 202, for example using hardware and/or adhesive. The telescoping tubes 212 have aligned longitudinal axes and successively decreasing transverse dimensions to permit each of the tubes 212 to axially slide therebetween. The telescoping tubes 212 are also hollow to permit the wire antenna element 206 to pass through the inside of the tubes 212. Note that in FIG. 4 the portion of the wire antenna element 206 passing through the hollow tubes 212 is shown in broken lines. The outermost tube 212*a* has the largest transverse dimension and is securable to the housing 202. The innermost tube 212*b* has the smallest transverse dimension and is axially moveable relative to the outermost tube 212*a*, as well as other tubes 212.

In some embodiments, the tubes 212 can be conductive. In such embodiments, the tubes 212 can be formed of metal, for example stainless steel or chrome-plated bronze. In such embodiments, the tubes 212 can be conductively connected to each other and to the wire antenna element 206.

In other embodiments, the tubes 212 can be RF transparent. In such embodiments, the tubes 212 can be formed of a plastic or polymer material.

A tab 218 is attached to the innermost tube 212*b* and serves as a down-stop for preventing the innermost tube 212*b* from sliding too far down into the other tubes 212.

The antenna assembly 200 is shown with the tubes 212 extended, but the tubes 212 can be retracted just as the tubes 112 are retracted in FIG. 1. The tubes 212 are telescoping such that a user can freely move the tubes 212 between a retracted position (such as is shown in FIG. 1) and an extended position (such as is shown in FIG. 2). The spool 208 spins to allow the wire antenna element 206 to extend while the tubes 212 are extended, and the retracting mechanism 210 causes the spool 208 to wind the wire antenna element 206 back onto the spool 208 as the tubes 212 are retracted. In some embodiments, the retracting mechanism 210 can be used to retract the tubes 212 from the extended position to the retracted position by pulling the wire antenna element 206 back onto the spool 208, which in turn pulls the button 216 towards the outermost tube 212*a* causing the tubes 212 to retract. In alternative embodiments, the spool 208 can be mechanically connected to the tubes 212 such that the spool 208 spins as the tubes 212 are extended and retracted, thereby winding and unwinding the wire antenna element 206 as needed.

Note that, in addition to an innermost tube 212*b* and an outermost tube 212*a*, the plurality of tubes 212 also includes an intermediate tube 212*c*. While the illustrated embodiment includes three tubes 212*a*-212*c*, alternative embodiments can include any number of tubes 212.

The antenna assembly 200 is shown with the tubes 212 extended and the wire antenna element 206 extended from out of the innermost tube 212*b*. The button 216 is detachable from the innermost tube 216. The button 216 can be configured to snap, twist, and/or screw onto the innermost tube 212*b*. For example, the button 216 can be configured to attach to the innermost tube 212*b* via a conventional bayonet-mount fastening mechanism. Alternatively, the button 216 can be attached to the innermost tube 212*b* via a spring-latch mechanism that requires a user to press a latch in order to release the button 216 from the innermost tube 212*b*. Once the button 216 is detached from the innermost tube 212*b*, the button 216 can be pulled in order to extract a portion of the wire antenna element 106 as shown. Depending on the size and material of the wire antenna element 206, the wire antenna element 206 may be more or less rigid. In some embodiments, the wire antenna element 206 can be flexible enough that it limply hangs from the upper end of the innermost tube 212*b* (the end of the innermost tube 212*b* from which the wire antenna element exits the tubes 212).

It is apparent that an invention with significant advantages has been described and illustrated. Although the present invention is shown in a limited number of forms, it is not limited to just these forms, but is amenable to various changes and modifications without departing from the spirit thereof.

I claim:

1. An antenna assembly, comprising:

a plurality of hollow elongated tubes having aligned longitudinal axes and successively decreasing transverse dimensions to permit each of said tubes to axially slide therebetween, said tubes comprising:

an outermost tube having the largest transverse dimension and being securable to a housing; and an innermost tube with the smallest transverse dimension having an upper portion, said innermost tube being axially moveable relative to said outermost tube;

a button detachably coupled to the upper portion of the innermost tube;

a retracting mechanism; and a wire antenna element, operatively coupled to a receiver and/or transmitter circuit, the element extending from the retracting mechanism to the button through the plurality of tubes, wherein the wire antenna element is attached to the button such that it remains attached to the button when the button is detached from the innermost tube and can thereby be extended from the upper portion of the innermost tube, and wherein the retracting mechanism is operable to retract the wire antenna element from beyond the upper portion of the innermost tube.

2. The antenna assembly according to claim 1, the plurality of elongated tubes further comprises at least one intermediate tube positioned between the innermost and outermost tubes, said intermediate tube being axially moveable relative to said outermost tube and to said innermost tube.

3. The antenna assembly according to claim 1, wherein plurality of elongated tubes includes at least one tube formed of a conductive material and conductively connected to the wire antenna element.

4. The antenna assembly according to claim 1, wherein plurality of elongated tubes includes at least one tube formed of a non-conductive material.

5. The antenna assembly according to claim 1, wherein the wire antenna element includes a metal wire formed of a conductive metal.

6. The antenna assembly according to claim 5, wherein the conductive metal includes copper.

7. The antenna assembly according to claim 1, wherein the innermost tube includes a tab extending therefrom such that the tab prevents the innermost tube from fully collapsing into the other tubes.

8. The antenna assembly according to claim 1, further comprising a spool operatively coupled to the retracting mechanism and about which at least a portion of the wire antenna element is wound after the retracting mechanism retracts the wire antenna element from beyond the upper portion of the innermost tube.

9. The antenna assembly according to claim 1, further comprising a connector, electrically connected to the wire antenna element, for connecting the antenna assembly to a radio.

10. A radio, comprising:

a receiver circuit; and an antenna assembly, comprising:

a plurality of hollow elongated tubes having aligned longitudinal axes and successively decreasing transverse dimensions to permit each of said tubes to axially slide therebetween, said tubes comprising:

an outermost tube having the largest transverse dimension and being securable to a housing; and an innermost tube with the smallest transverse dimension having an upper portion, said innermost tube being axially moveable relative to said outermost tube;

a button detachably coupled to the upper portion of the innermost tube;

a retracting mechanism; and a wire antenna element, operatively coupled to the receiver circuit, the element extending from the retracting mechanism to the button through the plurality of tubes, wherein the wire antenna element is attached to the button such that it remains attached to the button when the button is detached from the innermost tube and can thereby be extended from the upper portion of the innermost tube, and wherein the retracting mechanism is operable to retract the wire antenna element from beyond the upper portion of the innermost tube.

11. The radio according to claim 10, the plurality of elongated tubes further comprises at least one intermediate tube positioned between the innermost and outermost tubes, said intermediate tube being axially moveable relative to said outermost tube and to said innermost tube.

12. The radio according to claim 10, wherein plurality of elongated tubes includes at least one tube formed of a conductive material and conductively connected to the wire antenna element.

13. The radio according to claim 10, wherein plurality of elongated tubes includes at least one tube formed of a non-conductive material.

14. The radio according to claim 10, wherein the wire antenna element includes a metal wire formed of a conductive metal.

15. The radio according to claim 14, wherein the conductive metal includes copper.

16. The radio according to claim 10, wherein the innermost tube includes a tab extending therefrom such that the tab prevents the innermost tube from fully collapsing into the other tubes.

17. The radio according to claim 10, further comprising a housing, wherein the outermost tube is attached to the housing.

18. The radio according to claim 17, wherein the plurality of tubes are disposed on an external side of the housing.

19. The radio according to claim 10, further comprising a transmitter circuit operably coupled to the wire antenna element.

20. The radio according to claim 10, the antenna assembly further comprising a spool operatively coupled to the retracting mechanism and about which at least a portion of the wire antenna element is wound after the retracting mechanism retracts the wire antenna element from beyond the upper portion of the innermost tube.

* * * * *